US008602051B2

(12) United States Patent
Proper et al.

(10) Patent No.: US 8,602,051 B2
(45) Date of Patent: Dec. 10, 2013

(54) TRAP-PRIMER SYSTEM FOR FLOOR DRAINS

(76) Inventors: Brent W. Proper, Boise, ID (US); Kenneth L. Smart, Caldwell, ID (US)

( * ) Notice: Subject to any disclaimer, the term of this patent is extended or adjusted under 35 U.S.C. 154(b) by 275 days.

(21) Appl. No.: 12/965,813

(22) Filed: Dec. 10, 2010

(65) Prior Publication Data

US 2011/0303303 A1 Dec. 15, 2011

Related U.S. Application Data

(60) Provisional application No. 61/285,436, filed on Dec. 10, 2009.

(51) Int. Cl.
*F16K 13/10* (2006.01)

(52) U.S. Cl.
USPC ..... 137/247.25; 137/247.43; 137/247.51; 4/672; 4/695

(58) Field of Classification Search
USPC ..... 137/98, 100, 118.05, 247.11, 247.25, 137/247.41, 247.43, 247.49, 247.51, 247, 137/625.4; 4/668, 672, 695
See application file for complete search history.

(56) References Cited

U.S. PATENT DOCUMENTS

| | | | | |
|---|---|---|---|---|
| 202,287 | A * | 4/1878 | Shedd | 137/247.11 |
| 705,933 | A * | 7/1902 | Keyt | 137/240 |
| 1,665,029 | A * | 4/1928 | Hartnett | 4/653 |
| 3,526,547 | A | 9/1970 | Shock | |
| 3,952,764 | A | 4/1976 | Keller | |
| 3,998,241 | A | 12/1976 | Jones et al. | |
| 4,218,786 | A | 8/1980 | Taglarino | |
| 4,337,795 | A | 7/1982 | Argyris et al. | |
| 4,357,957 | A | 11/1982 | Bisonaya et al. | |
| 4,493,343 | A | 1/1985 | Arnold et al. | |
| 4,497,337 | A | 2/1985 | Mosbrucker et al. | |
| 4,574,399 | A | 3/1986 | Sullivan | |
| 4,811,431 | A | 3/1989 | Kraverath | |
| 4,882,789 | A | 11/1989 | Kraverath | |
| 5,287,877 | A | 2/1994 | Ackroyd | |
| 5,373,592 | A | 12/1994 | Stoltenberg et al. | |
| 6,422,260 | B2 | 7/2002 | Danowski et al. | |

(Continued)

OTHER PUBLICATIONS http://www.merriam-webster.com/dictionary/faucet, Nov. 2012.*

(Continued)

*Primary Examiner* — Eric Keasel
*Assistant Examiner* — R. K. Arundale
(74) *Attorney, Agent, or Firm* — Pedersen and Company, PLLC; Ken J. Pedersen; Barbara S. Pedersen

(57) ABSTRACT

A priming-water conduit from a sink water faucet unit to a floor drain p-trap is located between the faucet valve and the faucet water-outlet. The faucet valve controls water flow into said conduit, and, therefore, into said p-trap, without any other valve or control system. The priming-water conduit may be attached, and in fluid communication with, various structures of the faucet that are downstream of the faucet valve(s), such as: the mixing chamber of a mixing faucet; the water line from the mixing chamber to the faucet outlet/nozzle; or any water-containing structure that is downstream of the faucet valve. Each time the faucet is turned on, by means of the manual faucet valve, a portion of the water passing from the valve to the mixing chamber and/or by other routes to the faucet outlet/nozzle, will flow into the priming-water conduit and to the p-trap.

12 Claims, 13 Drawing Sheets

(56) References Cited

U.S. PATENT DOCUMENTS

| | | | | |
|---|---|---|---|---|
| 6,546,948 | B2 * | 4/2003 | Tarzia | 137/98 |
| 2007/0271695 | A1 * | 11/2007 | Thomas et al. | 4/675 |
| 2008/0023085 | A1 * | 1/2008 | Rosko et al. | 137/625.4 |
| 2008/0072967 | A1 | 3/2008 | Wen | |

OTHER PUBLICATIONS

Trail piece trap priming assembly, Sep. 30, 2009, p. 1-2, Precision Plumbing Products, http://www.pppinc.net.

Flush valve primer, Sep. 30, 2009, p. 1, Precision Plumbing Products, http://www.pppinc.net.

Prime-rite trap primer valve, Sep. 30, 2009, p. 1-3, Precision Plumbing Products, http://www.pppinc.net.

Waker closet primer, Sep. 30, 2009, p. 1-3, Precision Plumbing Products, http://www.pppinc.net.

Solo-prime electronic trap priming assembly, Sep. 30, 2009, p. 1-2, Precision Plumbing Products, http://www. pppinc.net.

MIFAB Trap seal primer selection guide, p. 1-4, prior to Sep. 30, 2009.

Automatic trap primer valve, prior to Sep. 30, 2009.

* cited by examiner

TRAP-PRIMER SYSTEM FOR FLOOR DRAINS

This application claims benefit of provisional application Ser. No. 61/285,436, filed Dec. 10, 2009, the entire disclosure of which is incorporated herein by this reference.

BACKGROUND OF THE INVENTION

1. Field of the Invention

The invention relates to trap-priming systems for floor drains. More specifically, the invention relates to a trap-priming system that supplies water to a p-trap of a floor drain by piping water from a sink faucet. The preferred priming water line to the p-trap originates from location(s) in the faucet unit that is/are between the faucet valve(s) and the faucet water outlet. This way, the trap-priming system is turned on each time the faucet is turned on, and does not require any valve other than the faucet valve or any complex systems such as pressure-sensing, solenoid, or flushometer tail piece system.

2. Related Art

Conventional floor drains, such as are used in utility rooms and including heat pump, air conditioning, and swimming pool facilities, and some bathroom and shower facilities, comprise p-traps typically directly below the floor drain hole. Such p-traps are well-known and comprise a generally horizontal, curved section of piping that holds water in the "trough" of the "p" to create a water seal between the upstream pipe (connected to the floor hole) and the downstream pipe (connected to the sewer or other waste water system). This water seal is mandated in modern plumbing systems to prevent flow of gasses from the sewer/waste-water system to the room containing the floor drain.

In many floor-drain applications, water typically flows from the floor surface into the drain only in the case of spills, accidents, leaks, or emergencies. Therefore, the water seal in the floor drain p-trap may go for days or weeks without being replenished by such water-flow from the floor. Thus, the water seal would tend to evaporate, if not for frequent replenishment from a priming system that supplies water to the p-trap from some source other than water on the floor surface. Conventional trap-priming systems comprise complex valves and/or electronics, such as automatic primer valves (see Prim-Rite™ trap primer valves, Prime Perfect™ trap primer valves), toilet primer valve systems (see Walker Closet™ primers, for example), and various continuous or pressure-drop-activated trap seal primers (see, for example, Solo-Prime™ Electronic Trap Priming Assemblies), and/or other equipment that tends to be expensive, inconvenient to install, unreliable, and/or difficult to monitor and maintain.

The invented trap-priming system solves many or all of the above-discussed problems, by providing a simple, efficient, reliable and economic solution for floor drain p-trap priming. The preferred system uses only clean water, rather than any waste water. The preferred system may be installed as OEM, or as a retrofit kit, without any modification to a conventional faucet except to provide a hole in a portion of the faucet to access a water-containing portion of the faucet downstream of the faucet valve.

SUMMARY OF THE INVENTION

The invention comprises a trap-priming system comprising a priming-water conduit extending from a portion of a water faucet unit to a floor drain p-trap, wherein said portion of the water faucet is located between the faucet valve or valves and the faucet water-outlet. The faucet valve(s) control (s) water flow into said priming-water conduit, and, therefore, into said p-trap, without requiring any other valve or control system to Wm the priming water on or off.

The priming-water conduit may be attached, and in fluid communication with, various structures of the faucet that are downstream of the faucet valve(s). In preferred embodiments, the priming-water conduit is attached to, and fluidly-communicates with, either: the mixing chamber/junction of a mixing faucet; the water line that extends from the mixing chamber/junction to the faucet outlet/nozzle; or any water-containing structure that is downstream of the faucet valve(s). This way, each time the faucet is turned on, by means of the manual or user-motion-activated faucet valve(s), a portion of the water passing from the valve(s) to the mixing chamber and/or by other routes to the faucet outlet/nozzle, will flow into the priming-water conduit and to the p-trap. Therefore, it may be said that water automatically enters the priming-water conduit upon opening of the manual or user-motion-activated faucet valve. This proportion of flow to the priming-water conduit vs. to the faucet outlet/nozzle may be determined by conduit/pipe size, a flow restriction orifice, and/or by other conventional flow restriction means. Preferably, there is no valve or other on-off and/or proportional flow control system in the priming-water conduit, or in any way associated with the priming system except for the faucet valve(s) provided as the valve(s) for controlling water out of the faucet outlet/nozzle to the user of the faucet/sink.

Many faucet and faucet valve designs are available in the market place, many or all of which may be easily adapted to comprise the invented trap-priming system. For example, a port may be drilled or otherwise provided in the faucet structure, to which the priming-water conduit is sealed by various means, including welding, soldering, threading, or other connection. This port and connection point for the priming-water conduit may be provided in all faucets of a manufacturer's product line, with the port and/or conduit plugged or otherwise sealed-off except for applications in which a trap-priming system is needed. The preferred trap-priming modification, consisting of a tube/pipe tapped into the mixing chamber or the faucet outlet line or nozzle, is a minimal structural change/addition that does not require changes in the valve or the faucet housing. This allows a manufacturer to provide trap-priming faucets and non-priming faucets that have substantially the same structure, and also the same external appearance once the faucet is installed. This allows customers to purchase a group of faucets all looking the same, with one or a small portion of the group being fitted for trap-priming and the others of the group either not having the trap-priming feature or having the trap-priming feature capped or plugged. See, for example, assembly 500 in FIG. 13 on sink counter C, wherein one faucet has port 217 connected to conduit 215, while one faucet has port 217 plugged by plug 505.

BRIEF DESCRIPTION OF THE DRAWINGS

In FIG. 12A, the valves and tubes/junction that allow mixing of the hot and cold water are supplied inside a faucet housing that is located entirely or substantially entirely above the sink- or counter-top, with the hot and cold fresh water supply entering the faucet unit from underneath, and through, said sink- or counter-top surface.

DETAILED DESCRIPTION OF THE PREFERRED EMBODIMENTS

Figure 1:
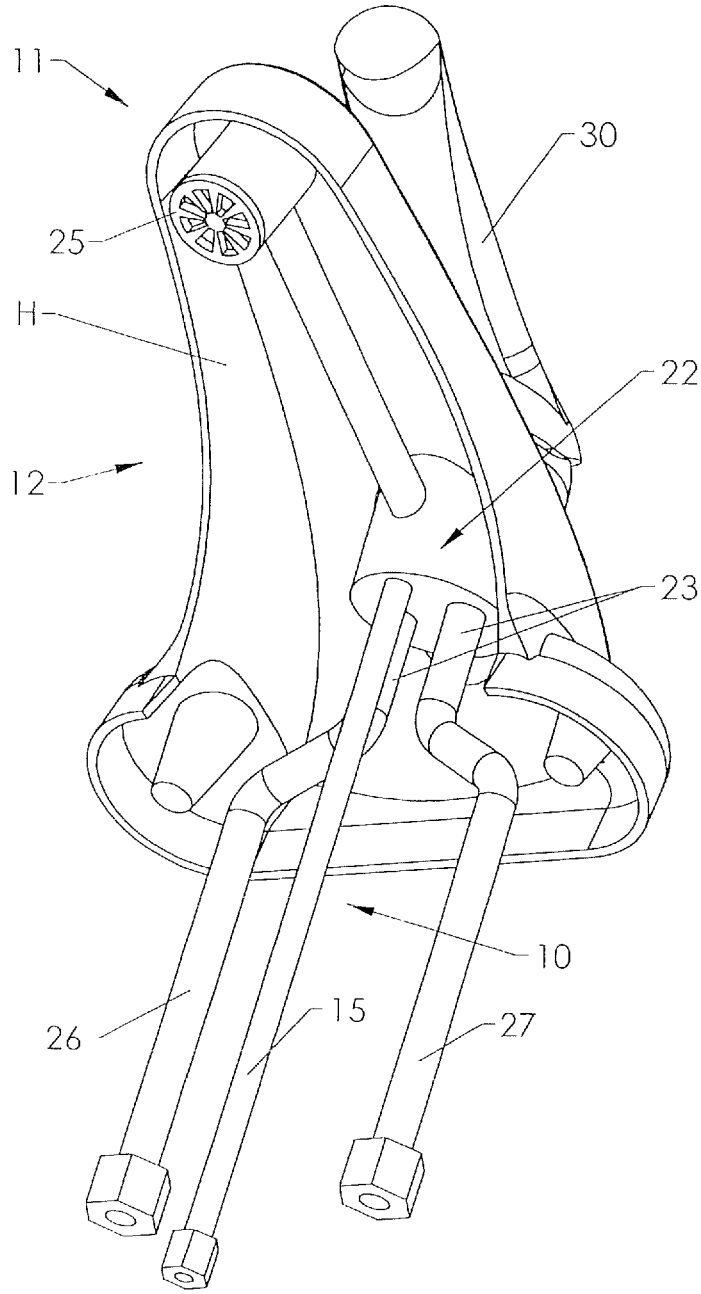
FIG. 1 is a bottom perspective view of one embodiment of a faucet comprising one embodiment of the invented trap-priming system.
Figure 2:
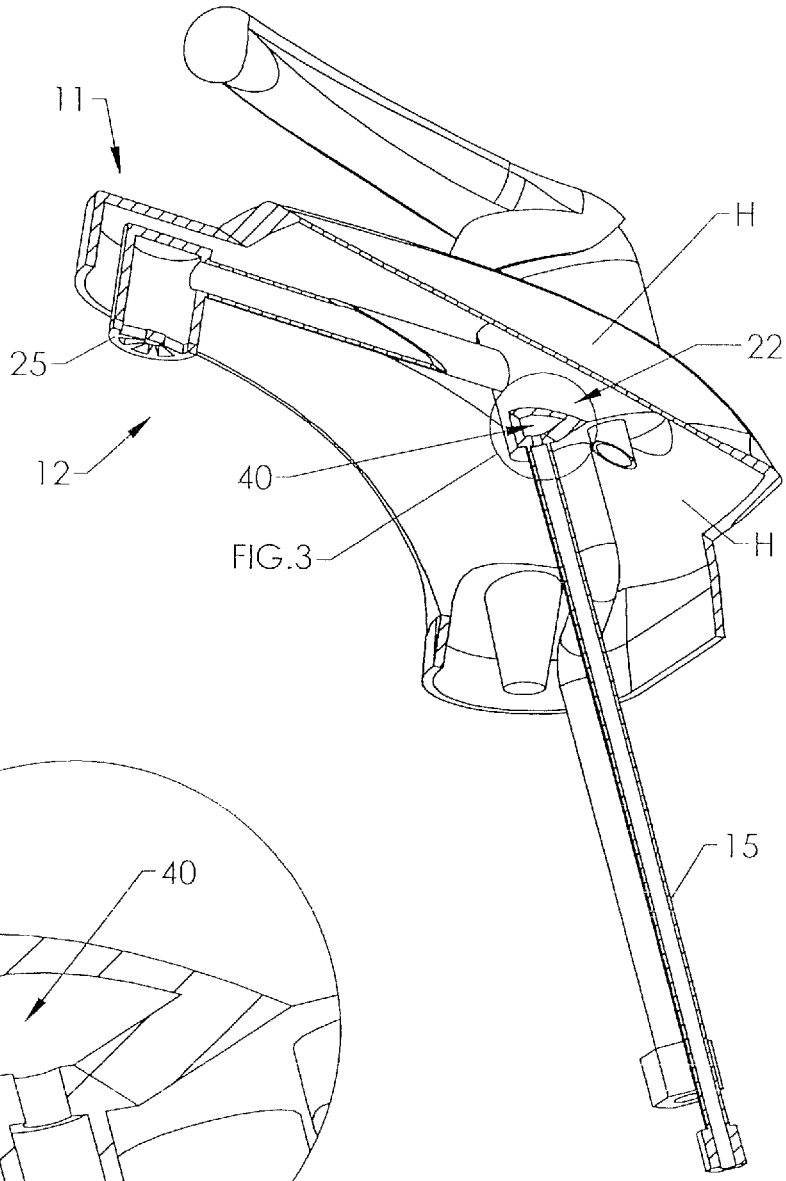
FIG. 2 is a side perspective view of the faucet of FIG. 1, with portions of the faucet housing, outlet nozzle, outlet tube, mixing chamber and the priming-water conduit cut away.
Figure 3:
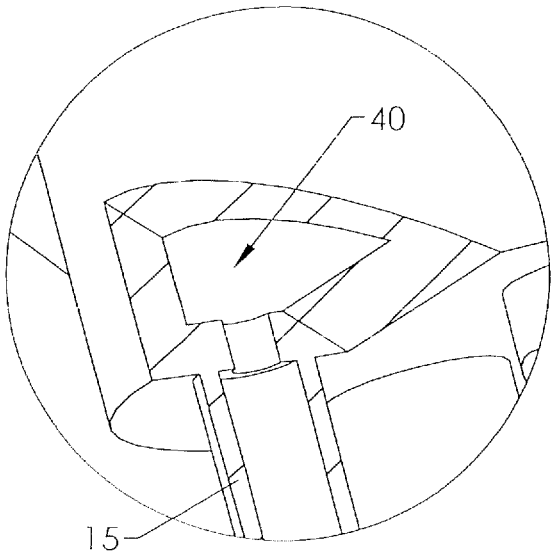
FIG. 3 is a close-up, detail view of a portion of the mixing chamber and priming-water conduit from FIG. 2.
Figure 2A:
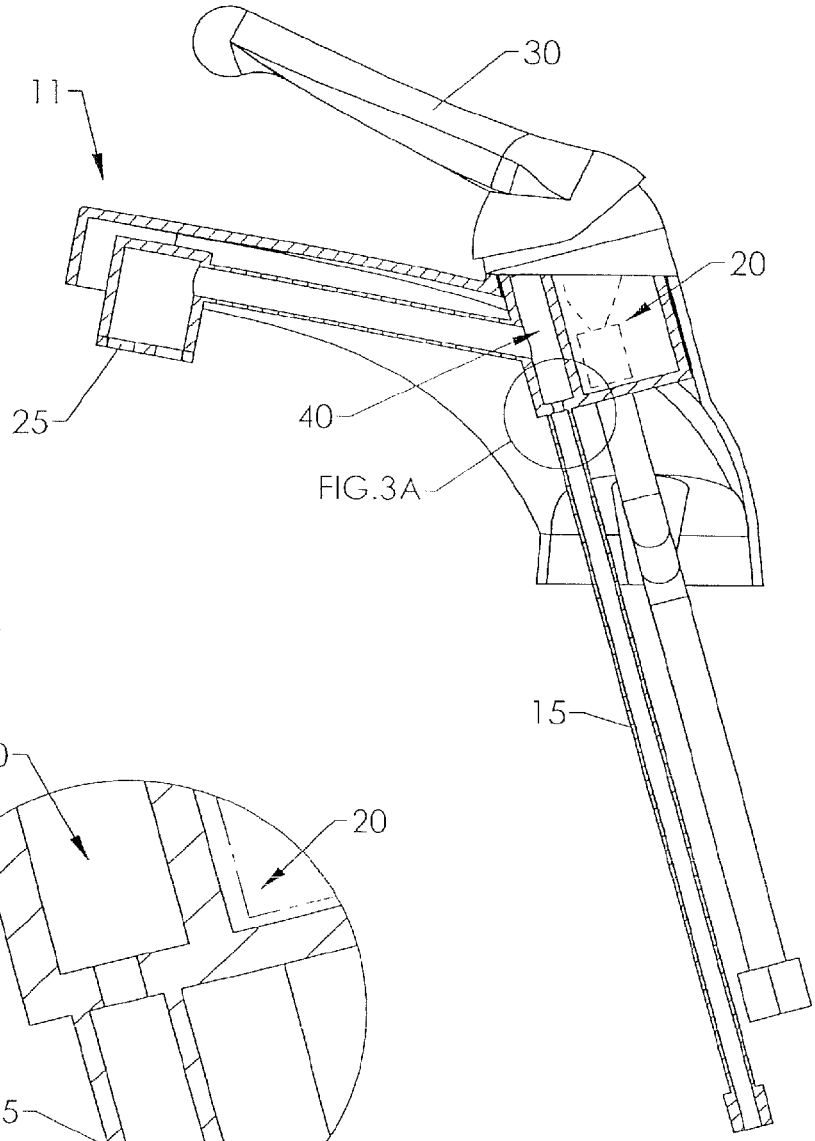
FIG. 2A is a side view of the faucet of FIGS. 1 and 2, with portions of the faucet housing, outlet nozzle, outlet tube, mixing chamber and the priming-water conduit cut away, at different locations compared to FIG. 2. The valve cartridge, including mixing chamber, shown schematically and without showing the valve details, as many faucet valves/cartridges known in the art may be used and will be understood by those of average skill in the art.
Figure 3A:
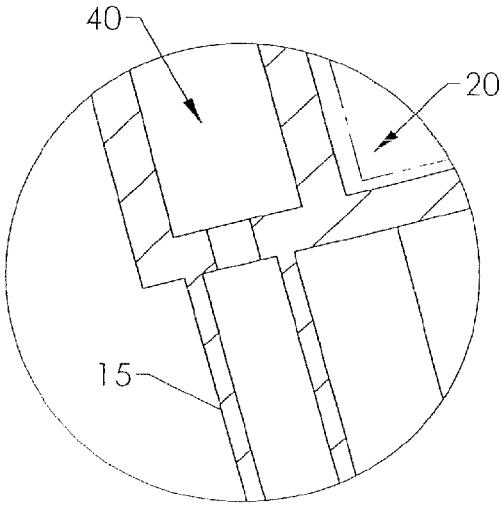
FIG. 3A is a schematic, detail view of a portion of the cut-away mixing chamber indicated in a circle in FIG. 2A.

Referring to the figures, there are shown several, but not the only, embodiments of the invented trap-priming system. The preferred trap priming system may comprise modifications of various faucets, some of which, but not all, are portrayed in the figures and in Exhibits A and B.

The preferred faucets are those frequently called "mixing faucets", wherein hot and cold water are joined prior to flowing to a single spout/outlet. Mixing faucets typically fall into two categories, one being the "single-lever" (single handle) type and the other being a "double- or two-lever" (two handle) type. In each of these mixing faucet types, the preferred embodiment of priming water conduit is provided at a location between the valve(s) and the water outlet, wherein the priming water conduit will receive water at a pressure significantly reduced relative to the pressure upstream of the valve (s). In the single-lever faucets, the preferred embodiment of priming water conduit is provided at a location between the single valve and the single spout outlet. In the double-lever faucets, the preferred embodiment of priming water conduit is provided at a location between two valves and the single spout outlet.

Less preferred faucets (not shown) are the type wherein two spouts are provided, one for hot and one for cold, with each of the spouts having its own valve and handle. These, therefore, are not "mixing" faucets. In these less preferred embodiments, the trap-priming conduit may be installed between the valve and the spout outlet of either of the spouts. The spout that is more likely to be used frequently probably would be chosen.

In the preferred single-lever mixing faucets, a single valve cartridge comprises a cam, wedge, or other mechanical system, controlled by the single lever/handle, that adjusts hot and cold water flow in amounts and proportions depending on the direction and extent of the lever/handle movement. Many such single-lever faucet valve cartridges are described in the patent literature and are known in this field of art. Both of said hot and cold water amounts flow out to the user through a single faucet tap outlet/nozzle or "single spout". Thus, the single lever/handle may be manually moved to a position wherein both hot and cold water are shut off and to various other positions allowing a wide range of proportions of hot and cold water to flow preferably into a mixing chamber or other junction, and then to the faucet outlet/nozzle (the "tap outlet") for use by a user of the sink. The "wide range of proportions" may be, for example, the hot water being 0-100% of the total of hot and cold water from the valve, with the cold water making up the remainder of the 100% of water flow. Several styles of single-lever mixing faucets, adapted to include embodiments of the invented trap-priming system, are shown in FIGS. 1-10, and FIG. 11 schematically portrays single-lever mixing faucets in general. Various companies manufacture these faucets, including but not limited to, Moen™, Delta™, and Zurn™.

The faucets illustrated in the Figures are manual faucets, wherein the user grasps the handle(s) and manually moves it/them to actuate and control the water flow. Alternative embodiments of the invention may include faucets wherein the user need not touch a faucet handle, as the faucet has a motion-sensing control feature, rather than manual-control, of water flow to the spout, and, hence, to the trap-priming water conduit. Thus, the user still controls the faucet, by virtue of his/her approaching the faucet closely enough and/or waving a hand closely enough, that the user-motion-activated valve cartridge opens water flow. Such motion-sensor-based, or other "hands-off" electric/electronic, systems are part of some conventional faucets, as known in the art, and are not a control or valve added for the trap-priming adaptation. Preferably, therefore, no sensors or electronic/electric controls are added because of the adaptation to make the faucet a trap-priming faucet.

Figure 11:
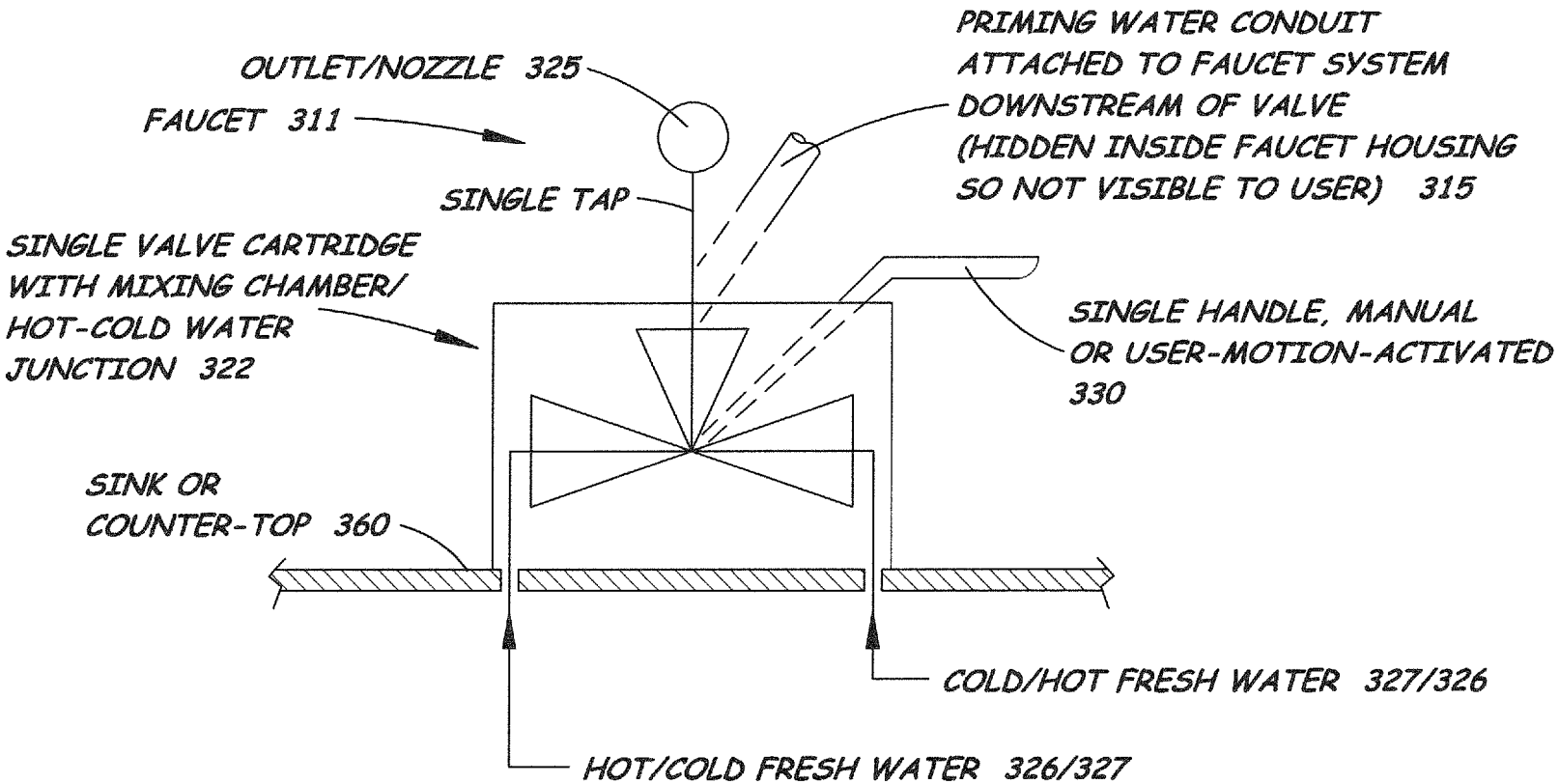
FIG. 11 is a schematic diagram of a typical single-lever (single-handle) mixing faucet, wherein a single spout/outlet, and a single lever/handle controls the relative flow of hot and cold water to the single spout/outlet. Typically, the faucet housing, valve cartridge, spout, and handle take the form of a single faucet unit positioned above the sink- or counter-top surface, with the hot and cold fresh water supply entering the faucet unit from underneath, and through, said sink-or-counter-top surface.

FIG. 11 is a schematic diagram of a typical single-lever (single-handle) mixing faucet 311 with priming-water conduit 315, wherein a single spout/outlet 325, and a single lever/handle 330 controls the relative flow of hot and cold water to the single spout/outlet 325. Typically, the faucet housing, valve cartridge 322, spout 325 and handle 330 take the form of a single faucet unit positioned above the sink- or counter-top surface 360, with the hot 326 and cold fresh water 327 supply entering the faucet unit from underneath, and through, said sink- or counter-top surface 360.

Figure 12A:
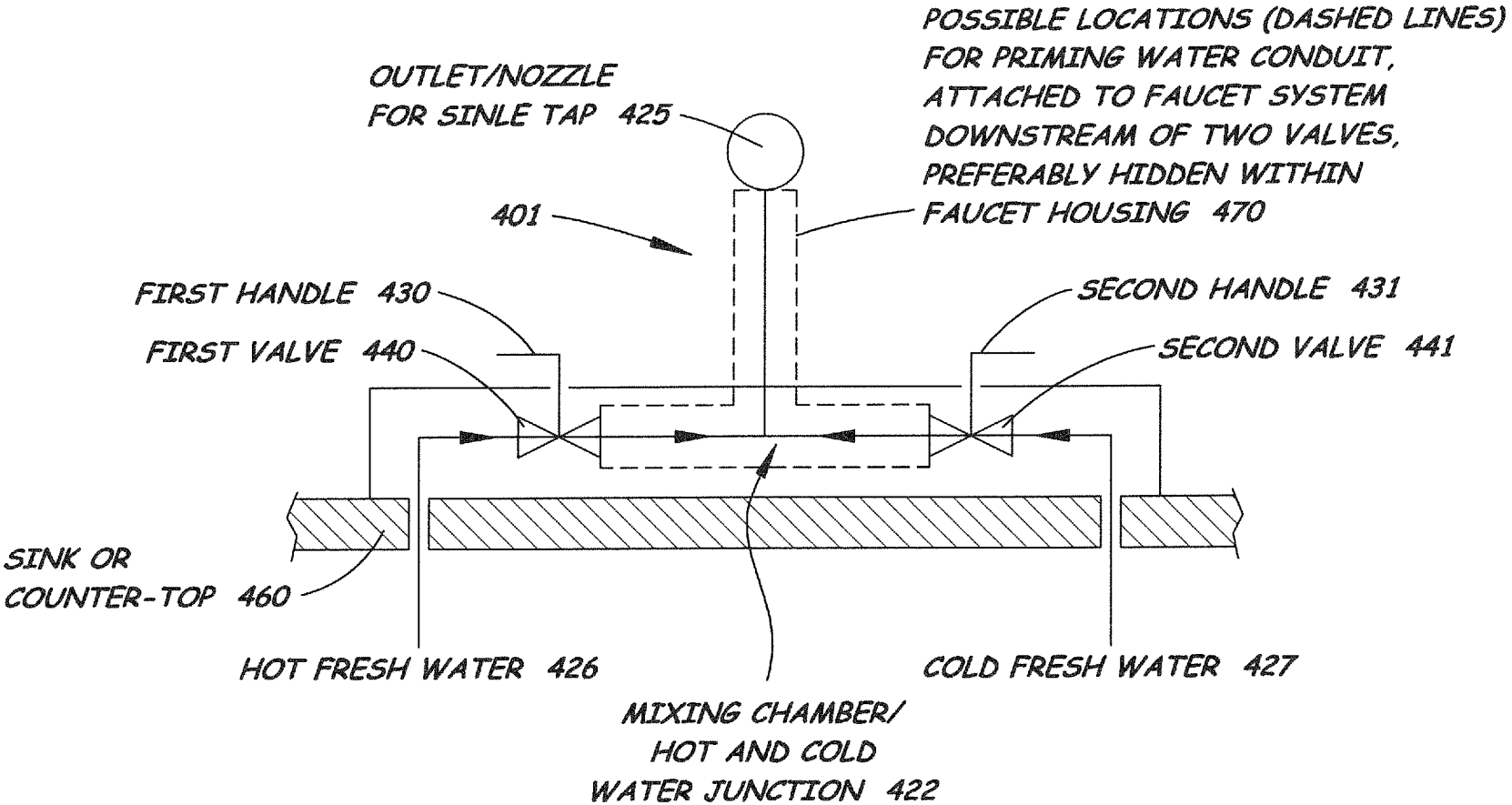
FIG. 12A is a schematic diagram of a typical double-lever (double-handle) mixing faucet, wherein a single spout/outlet is provided, but two valves are provided (one on the hot water supply and one on the cold water supply).
Figure 12B:
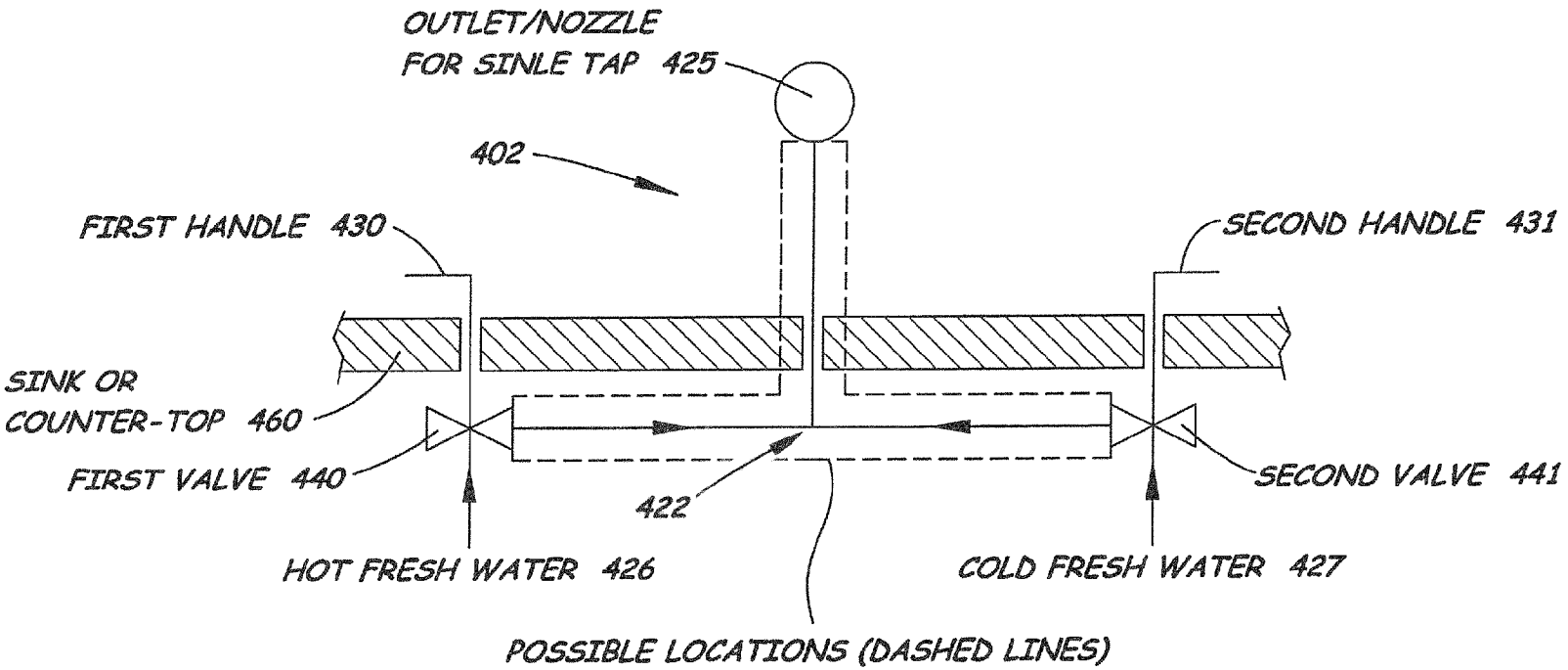
FIG. 12B is a schematic diagram of another double-lever (double-handle) mixing faucet, wherein the valves and tubes/junction that allow mixing of the hot and cold water are located entirely or substantially entirely below the sink- or countertop, and the structure typically visible to the user comprises the spout and the two handles, spaced-apart on the sink- or counter-top surface.
Figure 13:
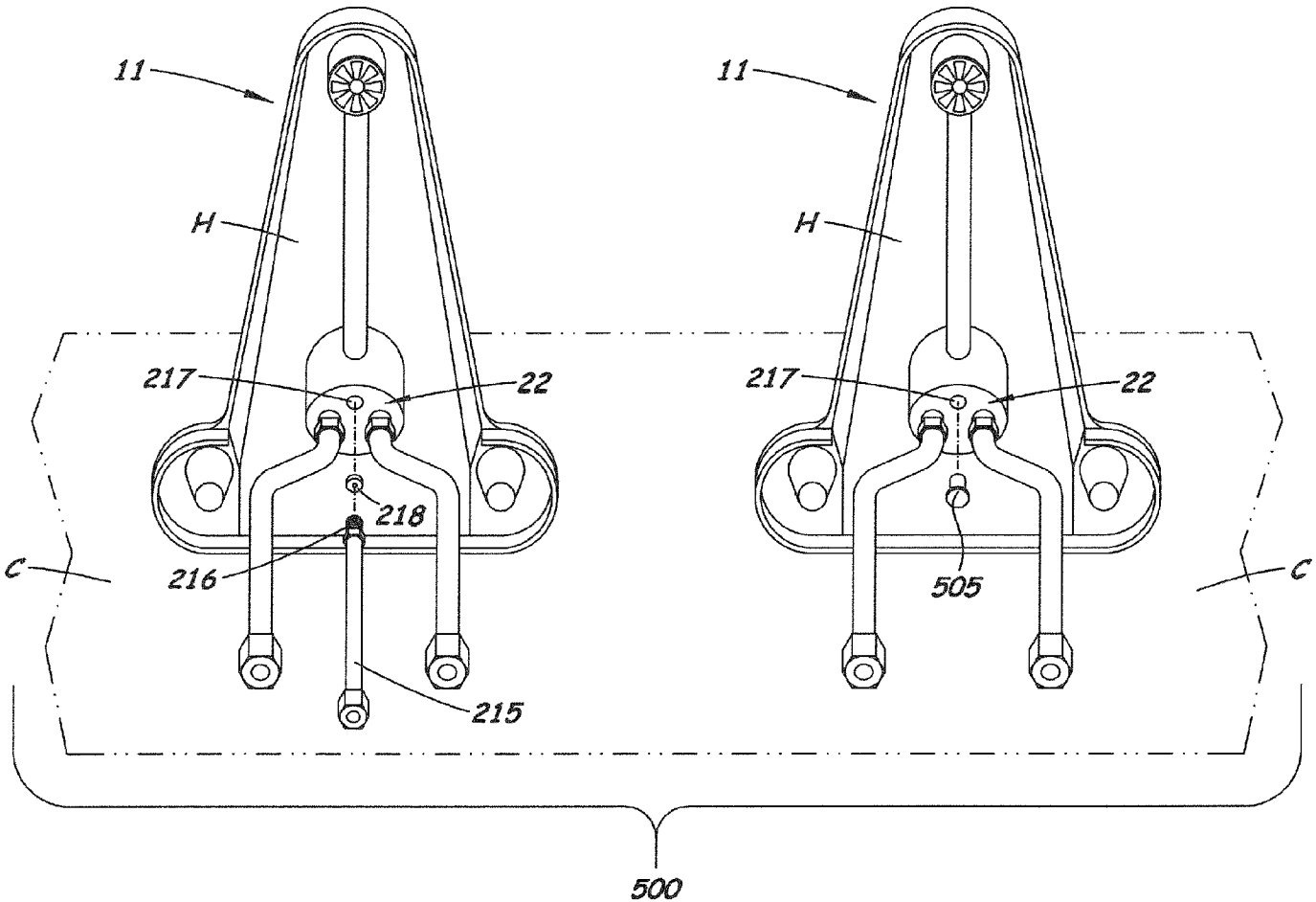
FIG. 13 is a portrayal of a set of faucets shown schematically installed on a counter near a sink, wherein each has a port in a mixing chamber, wherein one port has a connected trap-priming water conduit, and one port is plugged.

Other embodiments 401, 402, generally represented in FIGS. 12A and B, respectively, comprise two handles spaced apart at the back of the sink, that is, first handle 430 and second handle 431. A first valve 440 and a second valve 441 (one associated with each handle) open and control water flow of cold and hot water, respectively, to a single, central faucet tap outlet/nozzle (single "spout" 425) generally centered between the two handles and valves. Hot water 426 and cold water 427 streams flow through their respective valves, and are then piped to a mixing chamber or other junction 422, either above the sink 460 inside an aesthetically-pleasing housing (FIG. 12A) or underneath the sink 460 (FIG. 12B), to reach the single tap/spout. The mixing chamber or other mixing region, therefore, typically may be considered the junction of the hot and cold water lines at/near the single faucet tap/spout. In such embodiments, the invented priming system may comprise a priming-water conduit attached, and in fluid communication with, various structures downstream of either one of the two faucet valves, for example, in possible locations 470 enveloped/encircled by dashed lines in FIGS. 12A and B. For example, the priming-water conduit may be attached to, and in fluid-communication with, either: the hot water line between the hot-water faucet valve and the mixing chamber/junction of the single tap; the cold water line between the cold-water faucet valve and the mixing chamber/junction of the single tap; the mixing chamber/junction of the single tap; the water line that extends from the mixing chamber/junction to the single faucet outlet/nozzle; or any other water-containing structure that is downstream of either one of the faucet valves.

Referring specifically to the preferred single-lever mixing faucets shown in the figures, the preferred trap priming system 10, 100, 200 may comprise modifications of various faucets. Faucets 12, 112 each have a single spout 11, 111, and a single valve cartridge 22, 122. A pipe, tube, or other water conduit 15, 115, 215, which may also be called a "water discharge pipe" is connected, to be in fluid communication with, a portion of the faucet that is downstream of the faucet valve and upsteam of, or in, the faucet outlet/nozzle. Thus, the conduit 15, 115, 215 may be installed in various places in the typically-several-inches of structure between the valve and the nozzle 25, 125. This places the conduit 15, 115, 215 in a location wherein it will receive water when the faucet valve is turned on, as it is in fluid communication with the water-containing outlet structure of the faucet. The faucet valve 20, 120 lies between the water source(s) and the conduit 15, 115, 215, so that said water sources do not feed the conduit 15, 115, 215 unless the valve 20, 120 is turned on.

The valve 20, 120 structures are not shown in detail in the drawings, but are shown schematically in dashed lines inside valve cartridges 22, 122, wherein "valve cartridge" generally refers to the entire valve system, including its housing, the valve elements (water blocking elements), the linkage between valve elements and the lever/handle, and a region that may be called the mixing chamber 40, 140. It will be understood by those of skill in the art that the single lever/handle 30, 130 is manually movable to many positions that control the valve 20, 120 to obtain various amounts of flow, and various proportions of hot to cold water. The valve and valve cartridge may be of various designs and sizes, but will be understood that the preferred ones comprise: inlet ports 23 for each of the hot water line 26 and the cold water line 27, valve elements that close and open to allow various flows amounts of each of the hot and cold water (schematically shown in dashed lines), operative connection (not shown) between the valve elements and the lever/handle 30, 130, and a mixing chamber/junction 40, 140 into which said various amounts of hot and cold water flow for at least some mixing prior to flowing to the faucet outlet/nozzle 25, 125.

In the Figures, there are shown two styles of valves cartridges 22, 122, which are quite differently shaped and sized. These two valves cartridges 22, 122 have differently-sized and differently-located mixing chambers 40, 140, due to their substantially-different designs. For example, mixing chamber 40 (FIGS. 1-3A, and 7-10) is a relatively large chamber that is more easily tapped-into with a connection for the priming-water conduit 15. The mixing chamber 140 of the valve cartridge 122 (FIGS. 4-6), on the other hand, will be understood to be a relatively smaller hot and cold water junction that may serve to adequately mix the two temperatures of water but that is not substantial enough or positioned conveniently for a connection for the conduit 115. Therefore, in the case of such valve cartridges 122 and other smaller-diameter cartridges, for example, the conduit 115 is preferably connected to the faucet outlet/nozzle 125, or, alternatively (not shown) connected to the water line 128 extending from the valve cartridge to the outlet/nozzle 125.

Figure 4:
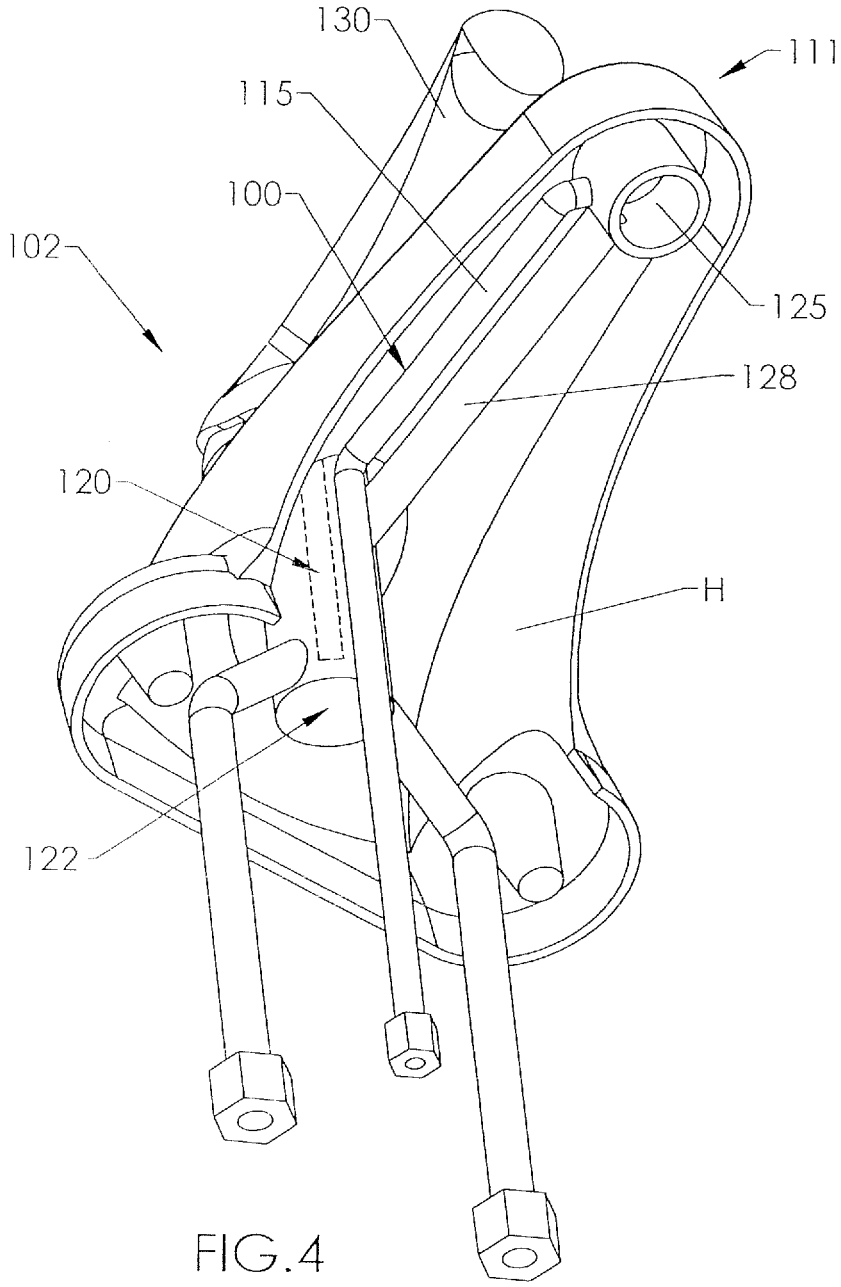
FIG. 4 is a bottom perspective view of another embodiment of a faucet, comprising another embodiment of the invented trap-priming system, wherein the faucet outlet is shown without any aerator attached to the opening of the faucet, for simplicity.
Figure 5:
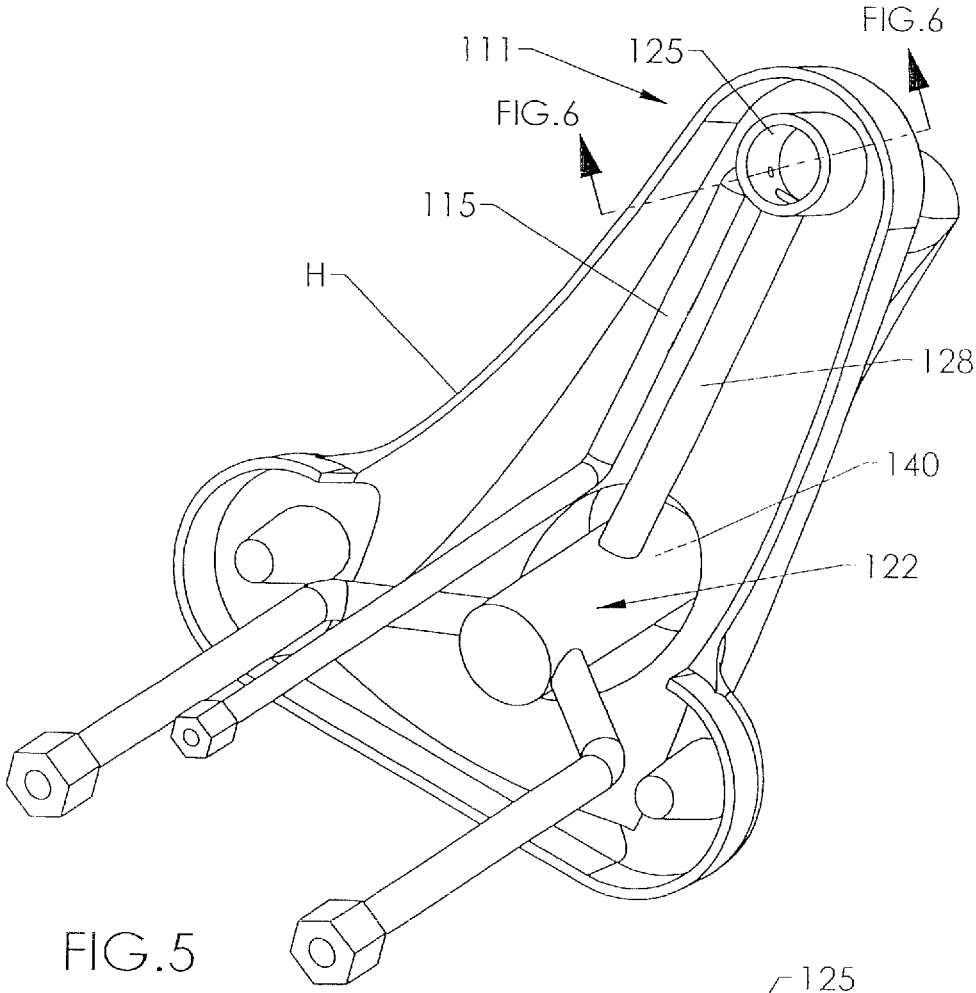
FIG. 5 is a bottom perspective view of the embodiment of FIG. 4, viewed from another angle.
Figure 6:
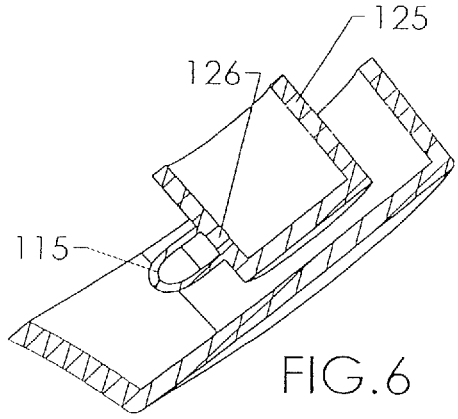
FIG. 6 is a close-up detail view of the outlet end of the faucet of FIGS. 4 and 5, viewed along the line 6-6 in FIG. 5.
Figure 7:
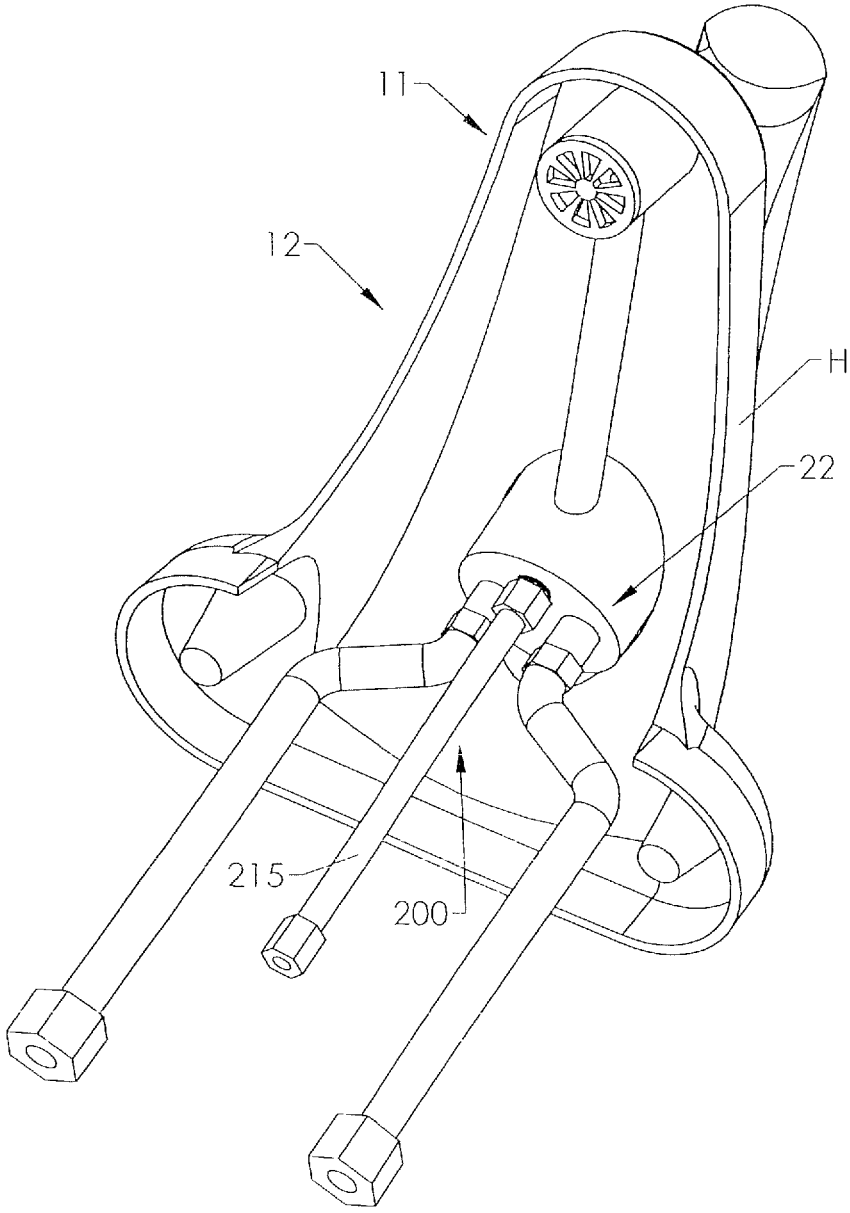
FIG. 7 is a bottom perspective view of another embodiment of the invented trap-priming system installed in a mixing chamber of an example faucet, similar to the embodiment of FIGS. 1-3A, wherein the priming-water conduit is attached to the mixing chamber by a threaded connection.

The conduit 115 in FIG. 4-6 is connected to the outlet/nozzle 125 by providing a hole 126 through a portion of a wall that defines/surrounds the outlet/nozzle 125, and placing the conduit 115 in fluid communication with said hole 126 (see FIG. 6). The conduit 115 preferably extends from said hole 126 generally along-side water line 128, and down through the inside of the faucet housing H, to exit the above-sink space through the same hole(s) as the fresh water supply line hole(s) (hot/cold) in the sink, adjacent countertop, or splashboard/wall. This way, the conduit 115 is contained inside the housing H when it is above the sink/countertop, so that conduit 115 is not visible under normal circumstances after installation. In a similar manner, in embodiments wherein the conduit is connected to the valve cartridge and/or the water line 128 to the faucet outlet/nozzle, none of the conduit is normally visible after installation because it extends through the housing H and through the fresh water line hole(s) in the sink, adjacent countertop, or splashboard/wall.

Preferably, the conduit is permanently or semi-permanently attached to the faucet in a way that does not block any portion of the faucet nozzle/outlet. Therefore, the conduit does not extend significantly, or at all, over or across the faucet outlet opening. This way, the faucet with trap-priming feature is usable at all times to provide water to the sink through the nozzle/outlet, and the trap-priming feature is operating each time the faucet is turned on to provide water to the sink. Specifically, the trap-priming system is not a temporary system that is installed over/around the faucet outlet/nozzle to receive all of the water flowing to the outlet/nozzle. Also, the trap-priming system is preferably not adapted in size or water flowrate to flush out the p-trap under the floor drain and/or any other p-trap, that is, is not adapted to provide so much water to any p-trap that it would flush out debris or other clogging from the p-trap.

Figure 8:
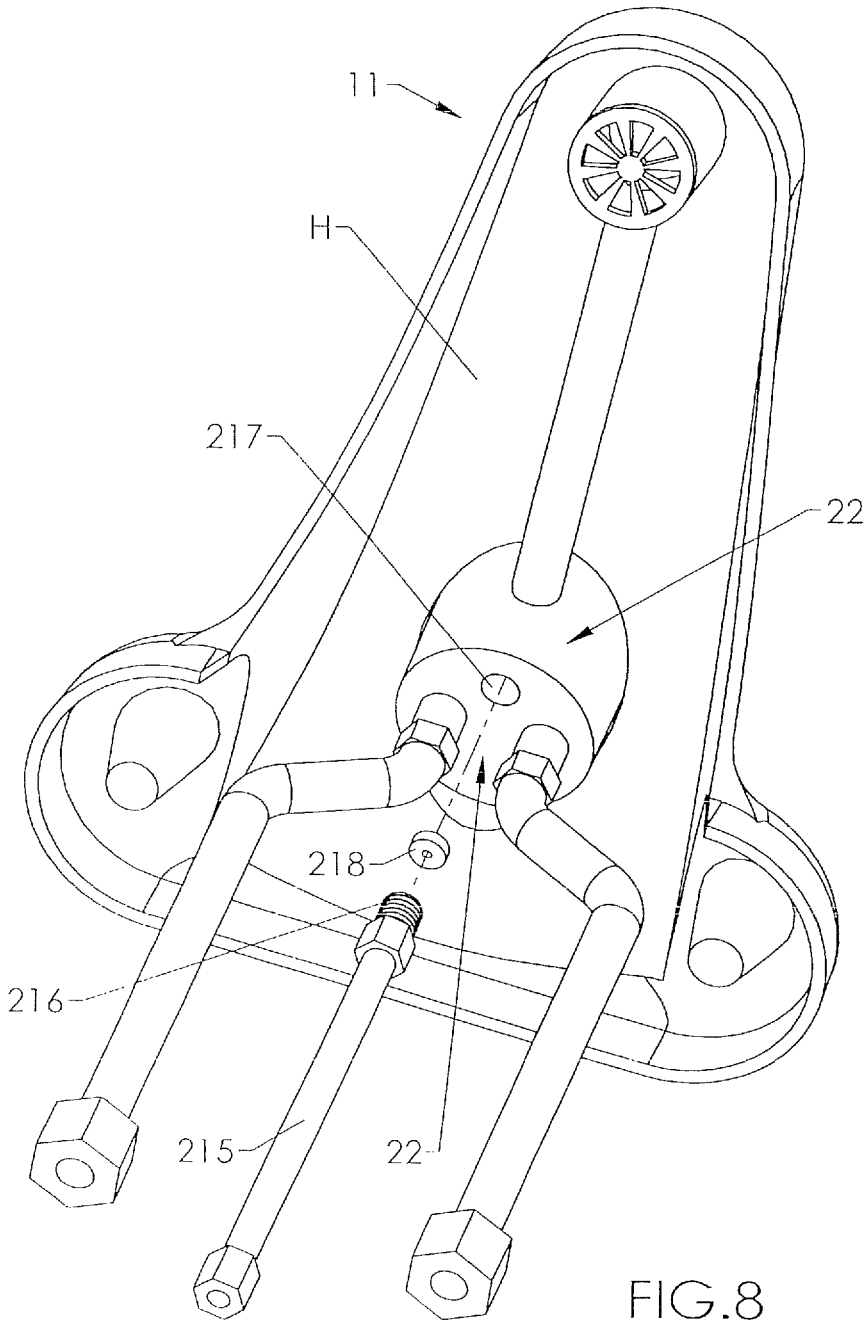
FIG. 8 is a bottom perspective view of the embodiment of FIG. 7, wherein the priming-water conduit and a flow-restriction orifice are shown in exploded view.
Figure 9:
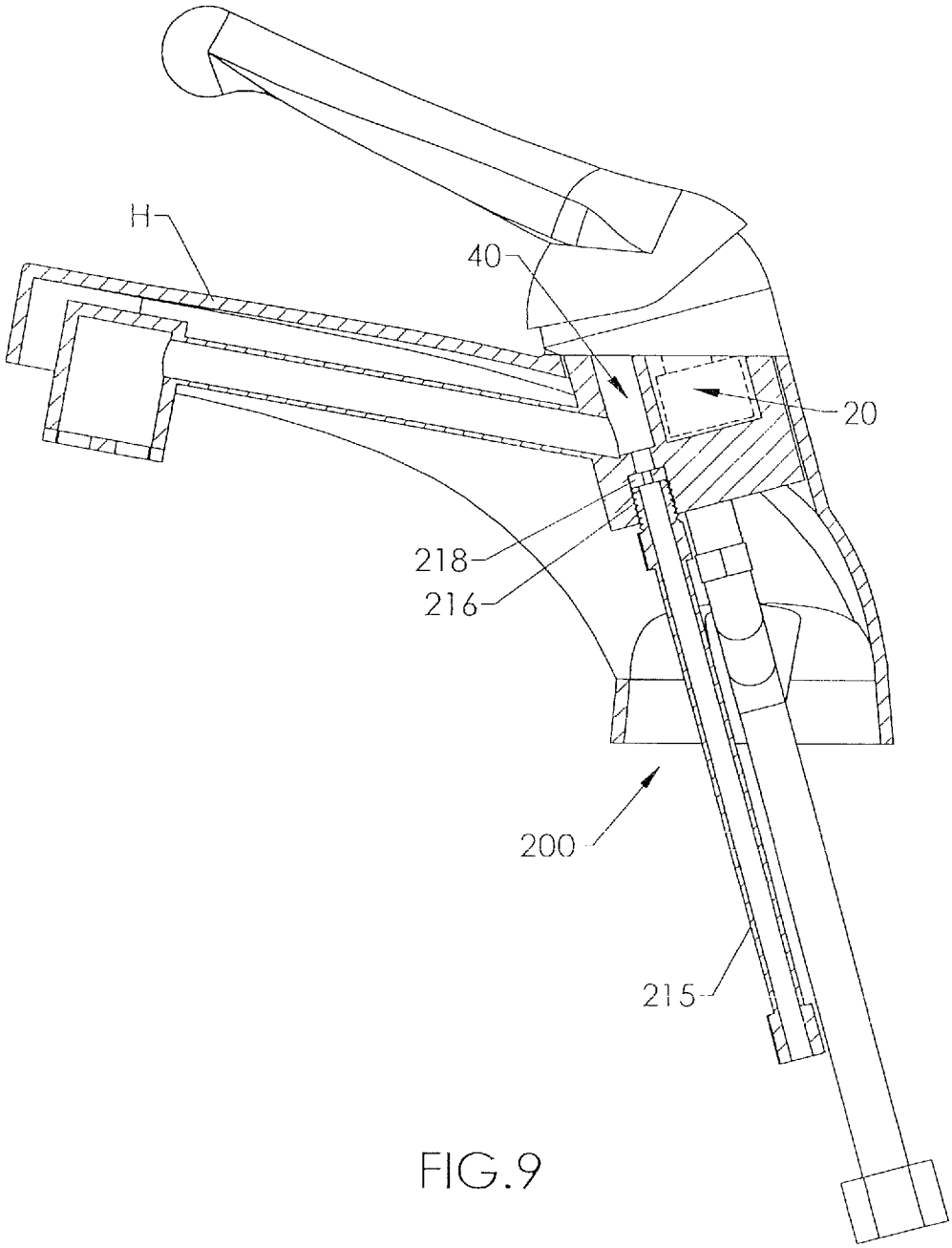
FIG. 9 is a cross-sectional, side view of the embodiment of FIGS. 7 and 8, wherein the valve cartridge, including the mixing chamber, are shown schematically and without showing the valve details, because many faucet valves/cartridges known in the art may be used and will be understood by those of average skill in the art.

In FIG. 8, one may note that the connection between the priming-water conduit 215 is a threaded connection to the valve cartridge housing, by means of a threaded fitting 216 on the conduit and a threaded bore 217. The connection is located in a place similar or the same as shown in FIGS. 1-3A. Bore 217 extends through the housing wall and into the mixing chamber 40 or other interior space in the valve cartridge that is downstream of the valve elements. This embodiment comprises a flow restriction orifice 218 inserted into the bore 217, chosen to provide the desired flow of priming-water through the trap-priming system 200. This embodiment, therefore, is one example of a removable conduit and removable and interchangeable orifice plate.

Flow restriction may be provided by means of orifice members (which are typically removable) and/or non-removable members, and/or by narrowing of the conduit passageway, as needed to balance the desired flow relative to the flow through the faucet outlet/nozzle, in removable and/or permanent conduits. It is preferred that said "restriction" or "narrowing", or other control of flowrate, is not done by a moving valve member, but rather by a simple orifice or smaller-diameter tube or fitting. Preferably, the flow restriction/control of trap-priming water results in the priming water flowrate being 1/100 up to 1/10 of the total flow leaving the valve cartridge, or, in other words, preferably in a range of 1 up to 10 percent water to the p-trap and 99 down to 90 percent water leaving the spout outlet. More preferably, about 1-4 percent of the water from the valve travels to the p-trap and about 99-96 percent exits the spout outlet.

Figure 10:
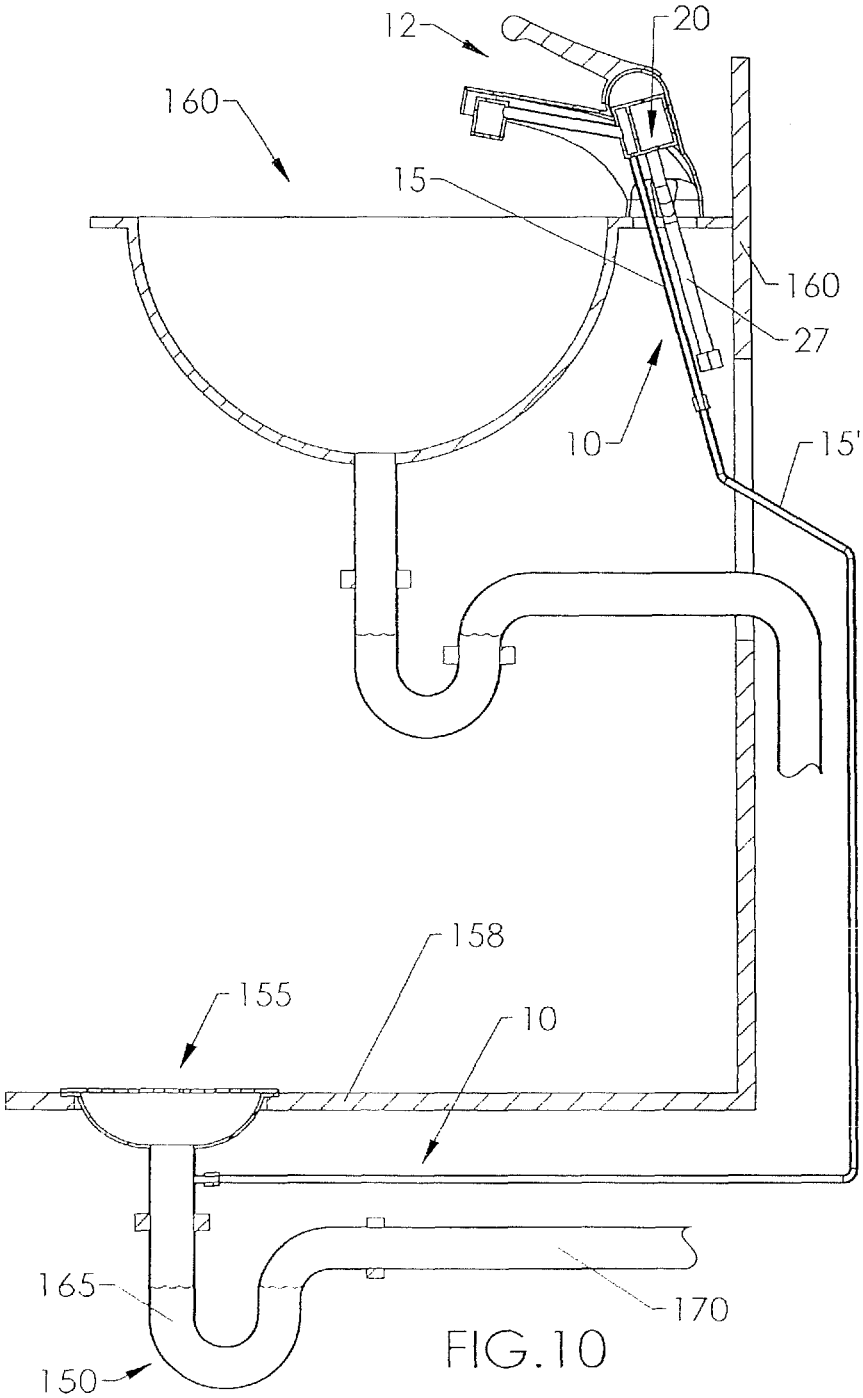
FIG. 10 is a side, partially-cross-sectional view of the embodiment of the invented trap-priming system of FIGS. 1-3A, installed in a sink, with the priming-water conduit extending to a floor-drain p-trap, again with the valve cartridge shown schematically. In this Figure, only one (27) of the fresh water lines is shown extending through a hole in the surface beneath the faucet, along with the priming-water conduit. It will be understood that said water line 27 will be connected to an upstream water supply, for example, fresh cold water, but it is shown in this figure as disconnected from said water supply, for simplicity.

As illustrated in the example room of FIG. 10, the conduit 15, 115, 215 extends from its connection to the faucet to the p-trap 150 of a floor drain 155, for example, in a region of a floor 158 adjacent to a sink 160 or other water basin/container using a faucet. The p-trap 150 and floor drain 155 may be more distant from the faucet 12, 112 and sink 160, for example, even in an adjacent room.

The primer-water conduit shown in FIG. 10 typically comprises the portion (15) that is connected to the faucet, and a longer portion 15' that extends through the wall 159 and down to a space beneath the floor where the p-trap 150 is positioned. The conduit 15' is connected to, and in fluid communication with, a portion of the p-trap 150 above the trough of the p-trap 150, so that water flowing from the conduit 15, 15' will fall to replenish the water seal 165 so that the water seal does not disappear in-between spills or other drainage into the floor drain 155 from the floor surface. The waste line 170 is understood to preferably extend to the sewer/waste water system.

As may be seen in the example of FIG. 10, the preferred trap-priming system 10 does not comprise any valve other than the conventional valve associated with the faucet that is adapted to open hot and/or cold water to the faucet outlet/nozzle. Therefore, there is preferably no valve anywhere along the conduit 15, 15', all the way from its connection to the faucet to the p-trap 150. Specifically, there is preferably no valve added to the faucet in addition to its conventional valve 20, 120, and there is no valve on/in the conduit underneath the sink, in the wall, or underneath the floor. The trap-priming system is simple and easy to access; there is preferably no access door required to reach the conduit 15' in the wall or underneath the floor, as there are preferably no moving parts and no electronics included in the trap-priming system (only the moving valve elements and the valve linkages of the faucet valve). Also, the trap-priming system preferably receives and transports only clean/fresh water from the faucet, rather than waste water from the sink drain or any other waste or discard water. This way, there will normally not be grit, dirt, grease, or other waste materials that would clog the conduit, optional orifice plate or optional check valve, the connections and optional fittings of the conduit at the faucet or the p-trap, and/or that would harbor significant bacterial or algal growth.

There are preferably no sensors that measure conditions at or near the p-trap to turn on water flow to the p-trap. While some faucets adapted to include embodiments of the trap-priming system may comprise a motion-sensor(s) or other "hands-off" electric/electronic systems for turning on the faucet, such sensor(s) and/or other hands-off system(s) are part of the conventional faucet, as known in the art, and are not an addition to the conventional faucet as an adaptation for trap-priming. Preferably, therefore, no sensors or electronic/electric controls are added because of the adaptation to make the faucet a trap-priming faucet.

A check valve or vacuum breaker only for the purpose of preventing water flow in the "wrong" direction through the conduit could be added, but the inventors do not believe that a check valve or breaker will be needed. The trap-priming conduit and it connection to the faucet are at the outlet side of the faucet valve, and generally at or very close to atmospheric pressure (rather than at the approximate 50 psi pressure upstream of the faucet valve). Also, said trap-priming conduit and said connection are fluidly connected to the faucet outlet/nozzle with relatively little pressure difference relative to said outlet/nozzle, the inventors believe that air flow into the outlet/nozzle would break any vacuum occurring in said conduit 15, 115, 215.

Although this invention has been described above with reference to particular means, materials and embodiments, it is to be understood that the invention is not limited to these disclosed particulars, but extends instead to all equivalents within the broad scope of the following claims.

The invention claimed is:

1. A trap-priming system utilizing water from a sink water faucet to automatically prime a floor drain p-trap when the water faucet is turned on, the system comprising:

a floor drain p-trap under the floor drain hole in a floor;

a sink above the floor; and a water faucet comprising a water-spout adapted to deliver hot water and cold water into the sink, a faucet valve, and a priming-water conduit;

wherein the priming-water conduit extends from a portion of the water faucet to said floor drain p-trap, said portion of the water faucet is located between said faucet valve and the water-spout, and said faucet valve controls water flow to said water-spout and into said priming-water conduit, so that, when said faucet valve is turned on, a first portion of the water flowing through said faucet valve flows to the water spout and into the sink and a second portion of the water flows into said priming-water conduit and to the p-trap so that said second portion primes the p-trap; and wherein the priming-water conduit extends from the faucet, underneath a countertop, through an adjacent wall, and underneath the floor to said p-trap, and wherein there is no valve in the priming-water conduit between said faucet and said p-trap.

2. A trap-priming system as in claim 1, wherein said priming-water conduit is connected to the faucet at a cold and hot water mixing chamber downstream of said faucet valve.

3. A trap-priming system as in claim 2, wherein the faucet valve controls both said cold water and said hot water so that the faucet is a single-valve and single-handle faucet and wherein only said faucet valve is necessary to turn the priming water on or off.

4. A trap-priming system as in claim 1, wherein the faucet valve controls both said cold water and said hot water so that the faucet is a single-valve and single-handle faucet.

5. A trap-priming system as in claim 4 wherein only said faucet valve is necessary to turn the priming water on or off.

6. A trap-priming system as in claim 4, wherein the first portion of the water and the second portion of the water are 90-99 percent and 1-10 percent, respectively, of total water flowing through said faucet valve.

7. A trap-priming system as in claim 1, further comprising an orifice placed in a bore in said faucet to reduce flow to said water-priming conduit.

8. A trap-priming system as in claim 1, wherein the water-priming conduit is connected to said faucet by a port in a cold and hot water mixing chamber provided in the faucet downstream of the faucet valve, and sealing of said priming-water conduit to said port by means selected from the group consisting of: welding, soldering, and a threaded connection.

9. A trap-priming system as in claim 8, wherein the first portion of the water and the second portion of the water are 90-99 percent and 1-10 percent, respectively, of total water flowing through said faucet valve.

10. A trap-priming system as in claim 1, wherein the first portion of the water and the second portion of the water are 90-99 percent and 1-10 percent, respectively, of total water flowing through said faucet valve.

11. A trap-priming system as in claim 2, wherein the first portion of the water and the second portion of the water are 90-99 percent and 1-10 percent, respectively, of total water flowing through said faucet valve.

12. A water faucet system comprising a first faucet and a second faucet, wherein:

said first faucet comprises:

a cold water inlet, a hot water inlet, a valve, a mixing chamber, a faucet spout, and a water line between the mixing chamber and the spout; and a priming-water conduit extending from said mixing chamber for connection to a floor drain p-trap, wherein said priming-water conduit is attached to said mixing chamber at a port that is in fluid communication with an interior space of said mixing chamber; and wherein said second faucet comprises:

a cold water inlet, a hot water inlet, a valve, a mixing chamber, a faucet spout, and a water line between the mixing chamber and the spout; and a port in said mixing chamber that is in fluid communication with an interior space of said mixing chamber, and a threaded plug threadably engaging, and liquid-sealed in, said port for sealing the port when no priming-water conduit is attached to said mixing chamber.

* * * * *